US005351788A

United States Patent [19]

DeJong

[11] Patent Number: 5,351,788

[45] Date of Patent: Oct. 4, 1994

[54] ROPE ARRANGEMENT FOR AN ELEVATOR CAR

[75] Inventor: Johannes DeJong, Järvenpää, Finland

[73] Assignee: Kone Elevator GmbH

[21] Appl. No.: 120,817

[22] Filed: Sep. 15, 1993

[30] Foreign Application Priority Data

Sep. 18, 1992 [FI] Finland ..... 924207

[51] Int. Cl.[5] ..... B66B 11/04

[52] U.S. Cl. ..... 187/264; 182/143; 254/337; 187/266

[58] Field of Search ..... 187/20, 23, 8.59; 254/334, 336, 337; 182/143, 142, 144

[56] References Cited

U.S. PATENT DOCUMENTS 1,710,442 4/1929 Warshaw ..... 187/8.59

4,830,146 5/1989 Nakamura et al. ..... 187/26

FOREIGN PATENT DOCUMENTS 0415218 6/1991 European Pat. Off. .

523345 4/1931 Fed. Rep. of Germany .

1032496 6/1958 Fed. Rep. of Germany ..... 187/20

50864 4/1976 Finland .

905565 9/1962 United Kingdom ..... 254/337

*Primary Examiner*—Robert P. Olszewski

*Assistant Examiner*—Kenneth Noland

[57] ABSTRACT

Rope arrangement for an elevator car. There is a hoisting machine and hoisting ropes moving the elevator car, in which a rope arrangement of the hoisting ropes of the elevator run over rope pulleys placed under the elevator car. The hoisting ropes run over the rope pulleys so that the transmission ratio between the speed of the elevator car and the rotational speed of the hoisting machine is at least 1:4.

6 Claims, 2 Drawing Sheets

ROPE ARRANGEMENT FOR AN ELEVATOR CAR

The present invention relates to an elevator rope arrangement for one with an elevator car.

At present, elevators are used in which the hoisting ropes run via pulleys placed below the elevator car. Such solutions can be used especially when the hoisting machine of the elevator is located at the side of the shaft. In the case of rope pulleys placed below the elevator car, the transmission ratio currently used is 1:2. In this context, transmission ratio refers to the speed of the elevator car in relation to the rope speed.

In large and heavy elevator applications, hydraulic elevators are used. These often have a multistage lifting cylinder. Especially elevators for heavy use and those With a large lifting height need multistage lifting cylinders. However, such lifting cylinders are very expensive and their maintenance is also expensive and complicated. Because of the buckling, the cylinders have a relatively low lifting height limit.

The object of the present invention is to eliminate the drawbacks of prior-art techniques and to achieve a rope elevator solution designed to replace, in particular, heavy hydraulic elevators. The elevator rope arrangement of an embodiment of the invention results in the hoisting ropes run by the underside of the elevator car providing a transmission ratio is at least 1:4.

The solution according to the invention provides advantages especially in the case of heavier elevators. It enables small geared elevator machines to be used instead of large gearless machines with a transmission ratio of 1:2. Moreover, when the rope pulley arrangement of the invention is used, the elevator car is completely balanced and the rope force is only ¼ or less of the weight of the car.

With respect to hydraulic elevators, a considerably lighter and cheaper solution is achieved.

Figure 1:
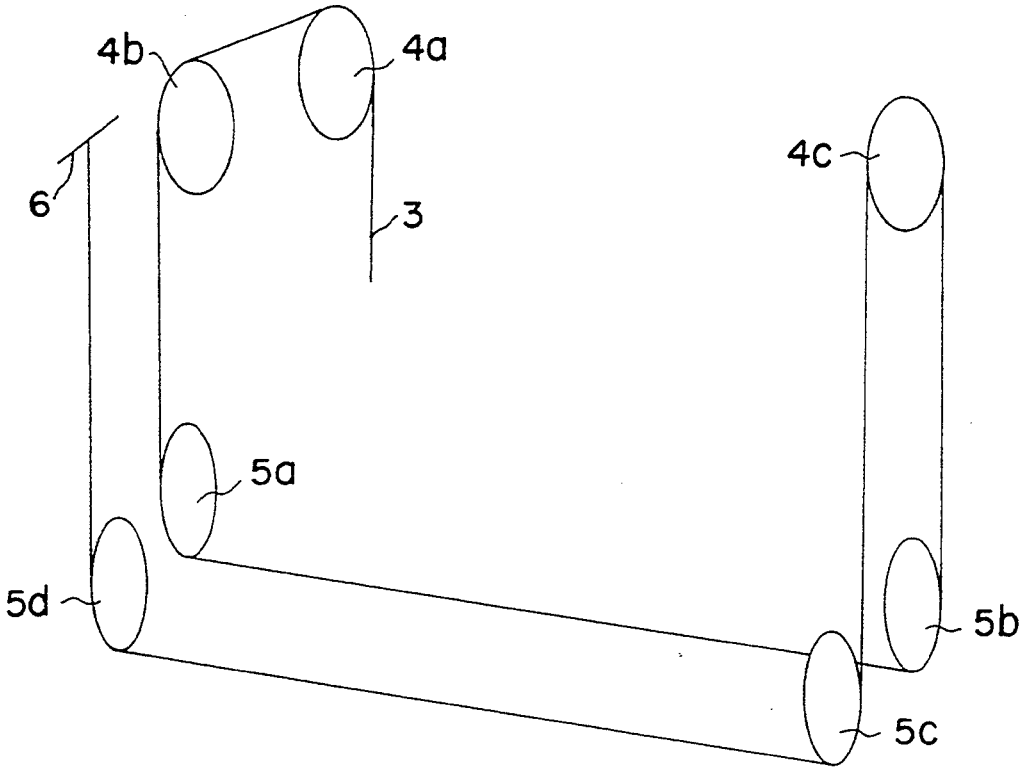

In the following, the invention is described in detail by the aid of an example by referring to the attached drawings, in which FIG. 1 presents the rope arrangement according to the invention.

Figure 2:
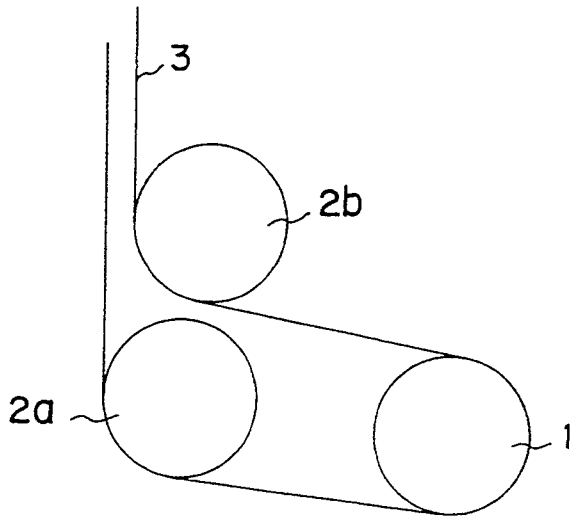

FIG. 2 presents the rope arrangement for the elevator machine.

Figure 3:
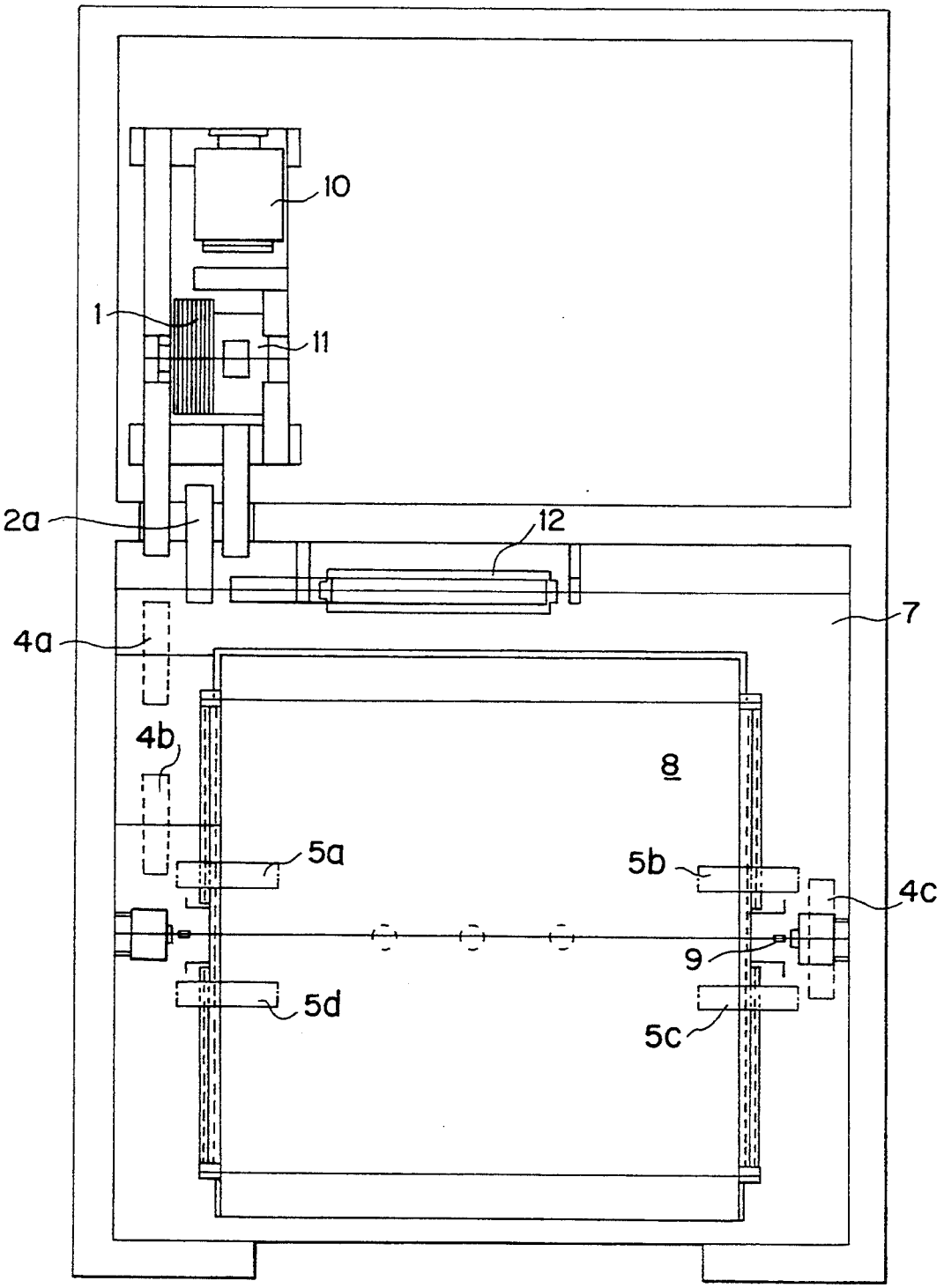

FIG. 3 presents a rope elevator according to the invention.

In the rope arrangement of the invention as presented in FIG. 1, the hoisting ropes 3 are passed via four pulleys 5*a*–5*d* placed under the elevator car at the points of a rectangle. In addition, the ropes pass round three diverting pulleys 4*a*–4*c* mounted on the wall of the elevator shaft above the elevator car. By using an arrangement where the ropes run via four pulleys under the elevator car as illustrated by FIG. 1, a transmission ratio of 1:4 between the car speed and the speed of rotation of the traction sheave will be achieved.

The ropes 3 run from the traction sheave 1 of the hoisting motor (FIG. 2) to one 2*a* of the two diverting pulleys of the machine and further to the first overhead diverting pulley 4*a* mounted on the wall of the elevator shaft. From here, the ropes 3 go to the second overhead diverting pulley 4*b* and further to the first rope pulley 5*a* mounted under the elevator car. Next, the ropes 3 pass via the second rope pulley 5*b*, which is aligned with the first one in the running direction of the rope, to the third overhead diverting pulley 4*c*. From this pulley they run via the third and fourth rope pulleys 5*c* and 5*d* to a rope anchorage 6 in the wall.

The other rope branch goes from the traction sheave 1 (FIG. 2) via the other diverting pulley 2*b* to the counterweight. The counterweight rope arrangement can be implemented independently of the car rope arrangement, so it will not be described here in detail.

FIG. 3 three illustrates an elevator car 8 which has rope pulleys 5*a*–5*d* mounted under it as described above and moves along guide rails 9 in an elevator shaft 7. Mounted on the wall of the elevator shaft are overhead diverting pulleys 4*a*–4*c*. The elevator machine consists of a hoisting motor 10 placed at the side of the shaft 7, a gear 11, a traction sheave 1 and a diverting pulley 2*a* of the hoisting motor. FIG. 3 also shows the counterweight 12.

The rope pulleys 5*a*–5*d* are arranged under the elevator car 8 at an angle relative to the centre line (dotted broken line) going through the diverting pulleys 4*a* and 4*b*. Line 4*a*–4*b* and the centre line of the rope pulleys 5*a*–5*d* under the car 8—this latter line being represented by the dotted broken line passing between said pulleys via the guide rails 9—form an angle which may vary between 25°–155° (in FIG. 3, 90°).

It is obvious to a person skilled in the art that different embodiments of the invention are not restricted to the example described above, but that they may instead be varied within the scope of the following claims.

I claim:

1. An elevator including a hoisting rope and elevator car comprising:

a hoisting machine and a hoisting rope for moving the elevator car;

four rope pulleys located below the elevator car;

three diverting pulleys mounted on a shaft for the elevator car;

the hoisting rope running in sequence from a traction sheave of an hoisting motor to a first diverting pulley of the hoisting motor to a second diverting pulley mounted on the shaft to a first and second rope pulley located below the elevator car to a third diverting pulley mounted on the shaft to a third and fourth pulley located below the elevator car to a rope anchorage located on the shaft to which the rope is attached;

so that the transmission ratio between the speed of the elevator car and the rotational speed of the hoisting machine is at least 1:4.

2. An elevator including a hoisting rope and elevator car according to claim 1, wherein said diverting pulleys mounted on the shaft being placed above the elevator car.

3. An elevator including a hoisting rope and elevator car according to claim 1 that the rope pulleys is four, and that the rope pulleys (5*a*–5*d*) are arranged below the elevator car are at an angle relative to a line going through two diverting pulleys mounted on the same wall of the shaft so that the line going through the diverting pulleys and the center line of the rope pulleys below the elevator car form an angle which varies in the range 25°–155°.

4. An elevator including a hoisting rope and elevator car according to claim 1, wherein the rope pulleys is four, and that the rope pulleys are arranged below the elevator car are located substantially at the points of a rectangle.

5. An elevator including a hoisting rope and elevator car according to claim 1, wherein said diverting pulleys mounted on the shaft are located above the rope pulleys below the elevator car.

6. An elevator including a hoisting rope and elevator car according to claim 1, wherein there is a counterweight to which the hoisting rope is attached.

* * * * *